US007155144B2

(12) United States Patent
Atwood et al.

(10) Patent No.: US 7,155,144 B2
(45) Date of Patent: Dec. 26, 2006

(54) PHOTORECEPTOR BELT TENSIONER PROVIDING LOW VARIATION IN BELT TENSION AS A FUNCTION OF BELT LENGTH

(75) Inventors: Mark A. Atwood, Rush, NY (US); Robert Hildebrand, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 271 days.

(21) Appl. No.: 10/909,137

(22) Filed: Jul. 30, 2004

(65) Prior Publication Data

US 2006/0024088 A1 Feb. 2, 2006

(51) Int. Cl.
*G03G 15/00* (2006.01)

(52) U.S. Cl. ..... 399/165; 198/813; 474/133

(58) Field of Classification Search ..... 399/165, 399/303, 312, 313, 329; 474/133, 135; 198/813, 198/814

See application file for complete search history.

(56) References Cited

U.S. PATENT DOCUMENTS

| | | | | |
|---|---|---|---|---|
| 4,983,146 | A | 1/1991 | Charles et al. | |
| 5,418,600 | A * | 5/1995 | Genovese | 399/167 |
| 5,717,984 | A | 2/1998 | Wong | |
| 6,055,398 | A | 4/2000 | Costanza et al. | |
| 6,088,559 | A | 7/2000 | Costabza et al. | |
| 6,101,353 | A | 8/2000 | Yu et al. | |
| 6,137,974 | A | 10/2000 | Williams et al. | |
| 6,249,662 | B1 | 6/2001 | Lee | |
| 6,253,047 | B1 | 6/2001 | Hildebrand et al. | |
| 6,269,231 | B1 * | 7/2001 | Castelli et al. | 399/165 |
| 6,363,600 | B1 * | 4/2002 | Pang | 29/426.5 |
| 6,606,475 | B1 * | 8/2003 | Maier et al. | 399/302 |
| 6,628,909 | B1 * | 9/2003 | Monahan et al. | 399/116 |
| 6,721,528 | B1 * | 4/2004 | Schreieder et al. | 399/302 |
| 6,766,129 | B1 * | 7/2004 | Loebel et al. | 399/165 |
| 7,024,136 | B1 * | 4/2006 | Fiore et al. | 399/165 |

FOREIGN PATENT DOCUMENTS

| | | |
|---|---|---|
| JP | 2000-172122 | 6/2000 |
| JP | 2000-172123 | 6/2000 |
| JP | 2000-181288 | 6/2000 |

* cited by examiner

*Primary Examiner*—Robert Beatty
(74) *Attorney, Agent, or Firm*—Maginot Moore Beck

(57) ABSTRACT

An apparatus for providing tension to a photoreceptor belt mounted for rotation about a plurality of fixed rollers mounted to a frame of an imaging device comprises a tensioning roller having a longitudinal axis and a convex contact surface for forcing a wrap angle with an inner surface of the photoreceptor belt, a moment arm mounted at a first end to the frame for pivotal movement relative to the frame about a pivot axis fixed relative to the frame and mounted at a second end to the tensioning roller; and a force exerting mechanism mounted to the frame and coupled through the moment arm to the tensioning roller to provide a force perpendicular to the longitudinal axis of the tensioning roller, the force exerting mechanism being configured to increase the force exerted thereby as the length of the photoreceptor belt increases.

19 Claims, 12 Drawing Sheets

FIG. 10
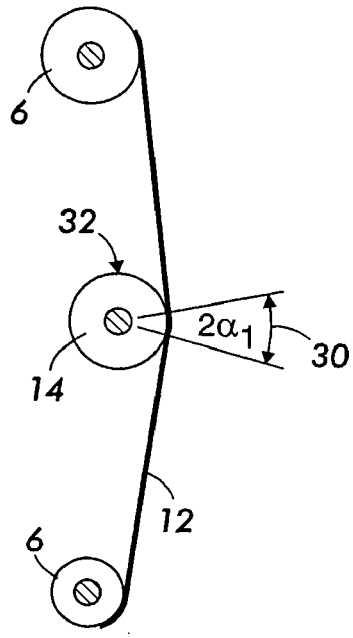
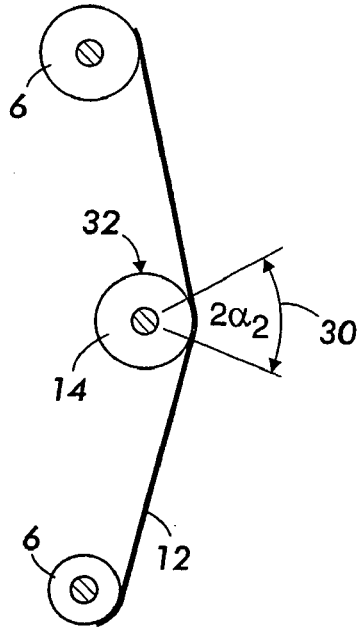
FIG. 11

PHOTORECEPTOR BELT TENSIONER PROVIDING LOW VARIATION IN BELT TENSION AS A FUNCTION OF BELT LENGTH

BACKGROUND AND SUMMARY

This disclosed device and method relates generally to image producing devices such as photocopiers and printer devices utilizing photoreceptor belts and more particularly to a device and a method for controlling the tension in a photoreceptor belt utilized in such imaging devices.

Image producing devices, such as photocopiers and laser printers, use toner and heat to produce an image on a sheet of paper or other media in a process known as electro-photography. In the art of electro-photography, a photoreceptor (typically in the form of a belt or a drum comprising a photoconductive insulating layer on a conductive layer) is imaged by first uniformly electrostatically charging the imaging surface of the photoconductive insulating layer. The photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible toner image can be transferred to a suitable receiving member such as paper. This imaging process may be repeated many times with reusable photoconductive insulating layers.

The photoreceptors are usually multilayered drums or belts. When photoreceptor belts are utilized in image producing devices, the belt is typically mounted to rotate about a plurality of rollers or drums. Such photoreceptor belts are typically manufactured to specific tolerances so that the belt can be made taut when mounted to the rollers and subjected to a tensioning force provided by a tensioner. The tensioner allows the belt to be installed and then brought to tension via a retraction device for retracting the tensioner or another drive roller from engagement with the photoreceptor belt. It is preferable that the tensioner sufficiently robust to adjust for these manufacturing tolerances so that pre-specified belt tension can be provided to belts of variable lengths. However, various belts meeting the manufacturing tolerances exhibit differing tensions when mounted to the rollers. Also, during use various forces exerted on the belt by the rollers, backer bars, cleaning, and transfer devices tend to result in dynamic changes to the belt length as seen at the tensioning device. Additionally, since the electro-photographic imaging process utilizes heat to fuse toner images transferred from the photoreceptor to the receiving member, the photoreceptor belt can be subjected to thermal expansion and contraction in use if the xerographic cavity is not adequately environmentally controlled. These manufacturing tolerances, dynamic forces and thermal expansion and contraction tend to cause the tension of the photoreceptor belts to vary. When the tension in the photoreceptor belt varies, the images produced may exhibit undesirable image quality.

Various devices and methods have been utilized to tension belts in imaging devices. One such belt tensioning device includes a belt engaging roller configured to be biased against the belt by a spring mechanism that exerts a force having a component perpendicular to the belt. In such devices, a compression spring oriented perpendicular to the belt is utilized to exert the force having a component perpendicular to the belt. Thus, as the belt length increases in such device, the tension placed upon the belt decreases. This decrease in belt tension as the belt length increases is not desirable.

Tensioning devices exist that attempt to limit the variation in photoreceptor belt tension for photoreceptor belts utilized in imaging devices. One such tensioning device is disclosed in U.S. Pat. No. 6,269,231 entitled Belt Tension Variation Minimizing Mechanism and A Reproduction Machine Having Same. While such belt tensioning device is effective in minimizing the variation in belt tension as a result of variations in belt length, the tensioning device utilizes relatively expensive components and is a relatively high resistant system. The high resistance of the system slows the response time of the belt tensioning system to belt length variations resulting from dynamic forces.

Persons in the imaging art would appreciate a belt tensioning device that utilizes relatively inexpensive components and reacts quickly to variations in belt length. Persons in the imaging art would appreciate a belt tensioning device that reacts to inboard to outboard variations in tension of the photoreceptor belt to maintain uniform tension across the photoreceptor belt.

According to one aspect of the disclosure, a tensioning device is provided for minimizing tension variations in a moveable endless belt having a desired tension setting and configured to be mounted for rotation about rollers mounted to a frame. The tensioning device comprises a movable member and a force exerting mechanism. The moveable member is mounted transversely to a direction of movement of the moveable endless belt and is movable into contact with the moveable endless belt. The force exerting mechanism comprises a first moment arm, a second moment arm and a biaser. The first moment arm is coupled at a first end to the frame for pivotal movement of the first moment arm about a pivot fixed relative to the frame. The first moment arm is coupled at a second end to a first end of the second moment arm. The second moment arm has a second end coupled to the moveable member. The second moment arm is coupled at the first end for pivotal movement relative to the first moment arm about a moveable pivot coupling the first and second moment arms. The biaser is coupled to the frame and the moveable pivot to bias the moveable pivot to urge the second end of the second moment arm away from the fixed pivot. The movement of the second end of the second moment arm away from the fixed pivot urges the moveable member into contact with the moveable endless belt, thereby tensioning the moveable endless belt and minimizing variations from the desired tension setting of the moveable endless belt.

According to another aspect of the disclosure, a tensioning device for minimizing tension variations in a moveable endless belt having a first edge having a diameter, a second edge having a diameter, a desired tension setting and being configured to be mounted for rotation about rollers mounted to a frame is provided. The tensioning mechanism comprises a first assembly, a second assembly and a moveable member. The first assembly has a first end coupled to the frame for pivotal movement of the first assembly about a first pivot axis fixed relative to the frame. The first pivot axis is transverse to the endless moveable belt. The second assembly includes a biased collapsible linkage having a first end coupled to the first assembly and a second end coupled to a second pivot axis fixed relative to the frame. The collapsible linkage is biased to urge a second end of the first assembly to pivot away from the second pivot axis toward the movable endless belt and is configured to increase its mechanical advantage as the first assembly pivots away from the second pivot axis. The moveable member has a longitudinal axis and a surface for contacting the moveable endless belt transversely to a direction of movement of the moveable endless belt. The movable member is coupled to the second end of the first assembly for pivotal movement about a third pivot axis transverse to the longitudinal axis. The first and second assembly cooperate to urge the contact surface of the moveable member into engagement with the moveable endless belt with the longitudinal axis parallel to the direction of movement of the moveable endless belt regardless of whether the diameter of the first edge is equal to the diameter of the second edge. The contact surface applies a tensioning force to the moveable endless belt having a force direction that is orthogonal relative to the direction of movement of the moveable endless belt, thereby tensioning the moveable endless belt.

According to yet another aspect of the disclosure, an apparatus for providing tension to a photoreceptor belt mounted for rotation about a plurality of fixed rollers mounted to a frame of an imaging device is provided. The tensioning apparatus comprises a tensioning roller, a moment arm and a force exerting mechanism. The tensioning roller has a longitudinal axis and a convex contact surface for forcing a wrap angle with an inner surface of the photoreceptor belt. The moment arm is mounted at a first end to the frame for pivotal movement relative to the frame about a pivot axis fixed relative to the frame and mounted at a second end to the tensioning roller. The force exerting mechanism is mounted to the frame and coupled through the moment arm to the tensioning roller to provide a force perpendicular to the longitudinal axis of the tensioning roller. The force exerting mechanism is configured to increase the force exerted thereby as the length of the photoreceptor belt increases.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

A more complete understanding of the disclosed apparatus can be obtained by reference to the accompanying drawings wherein:

FIG. 10 is a force diagram showing the manner in which the photoreceptor belt wraps around the tensioning roll when a shorter photoreceptor belt is utilized as in FIG. 7;

FIG. 11 is a force diagram showing the manner in which the photoreceptor belt wraps around the tensioning roll when a longer photoreceptor belt is utilized as in FIG. 8;

Figure 1:
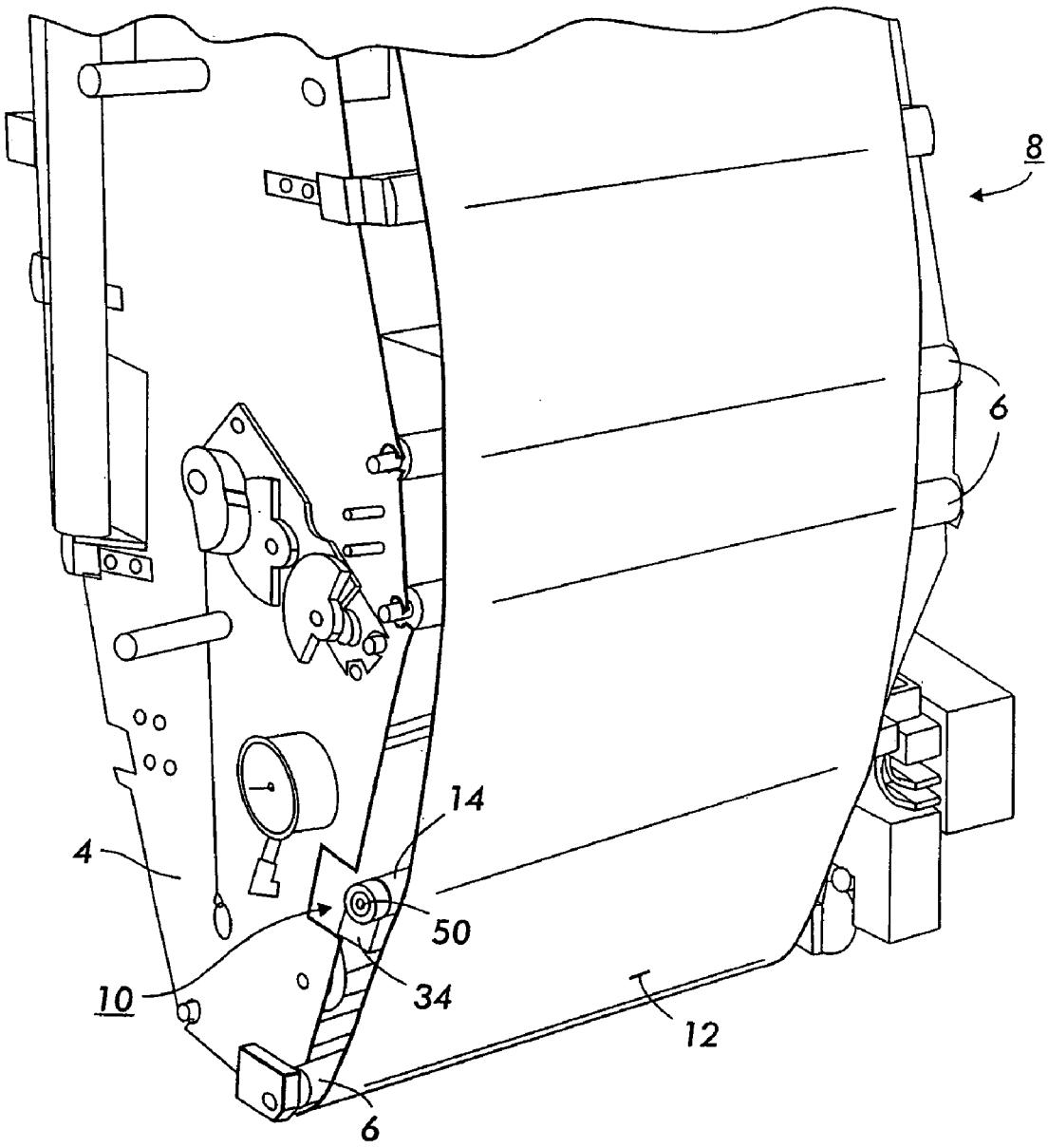
FIG. 1 is a perspective view of the frame of an imaging device showing a photoreceptor belt carried on fixed rollers and tensioned by the tensioning device.
Figure 2:
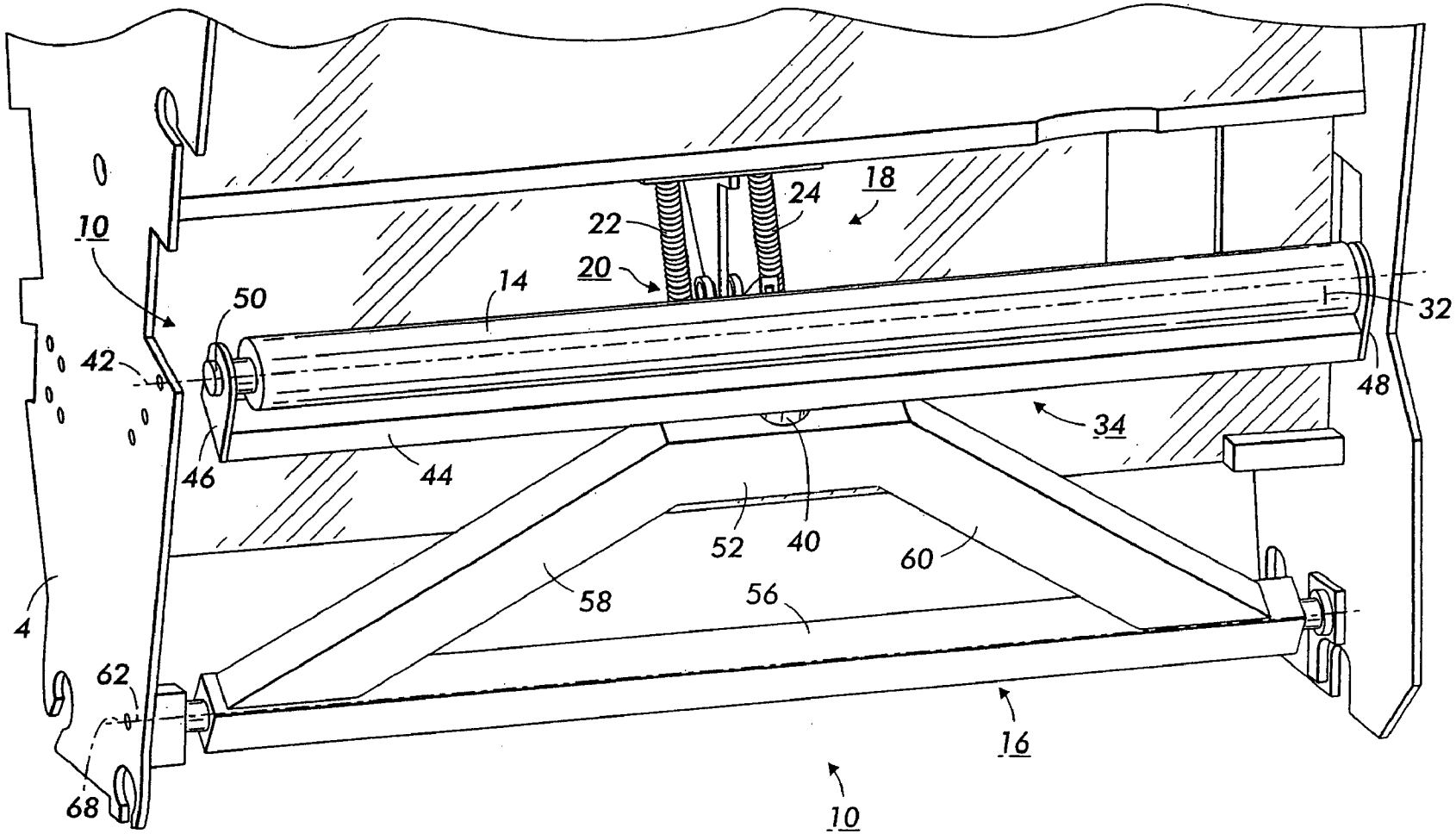
FIG. 2 is a perspective view showing the frame of the imaging device with the photoreceptor belt and fixed rollers removed to more clearly show the tensioning device and the mounting of a pivoting frame of the tensioning device to the frame of the imaging device.
Figure 3:
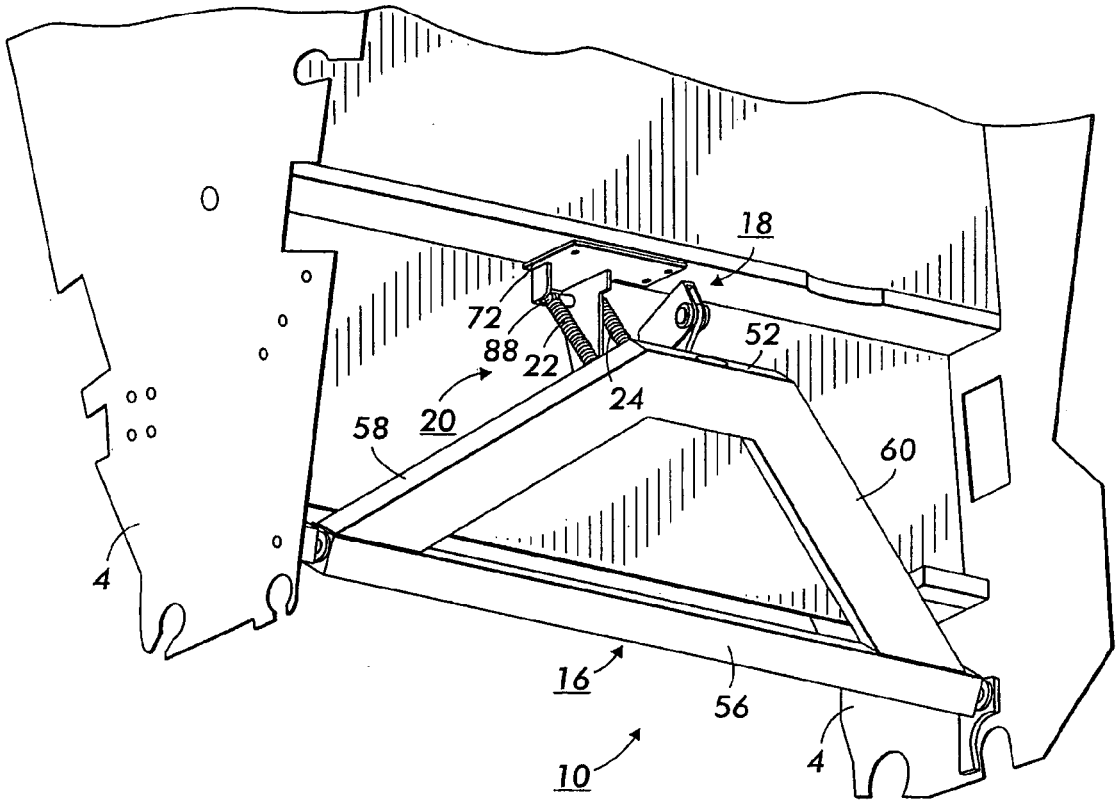
FIG. 3 is a perspective view of the frame and tensioning device with the tensioning roller removed to more clearly depict a bracket of the tensioning device mounted to a cross member of the frame.
Figure 4:
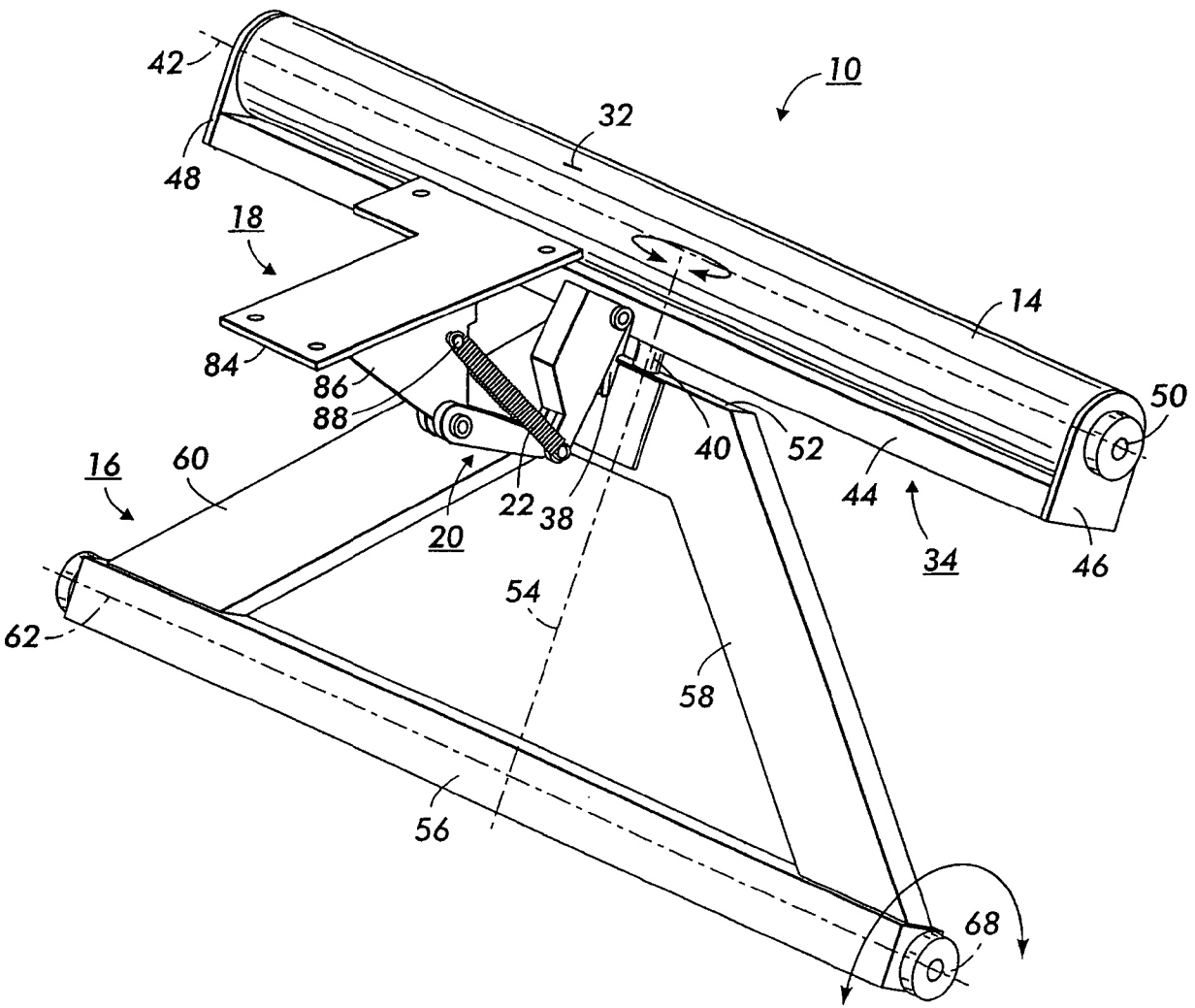
FIG. 4 is a perspective view of the tensioning device removed from the frame to more clearly show the roll frame mounted by a pivot pin to the pivoting frame of the device.
Figure 5:
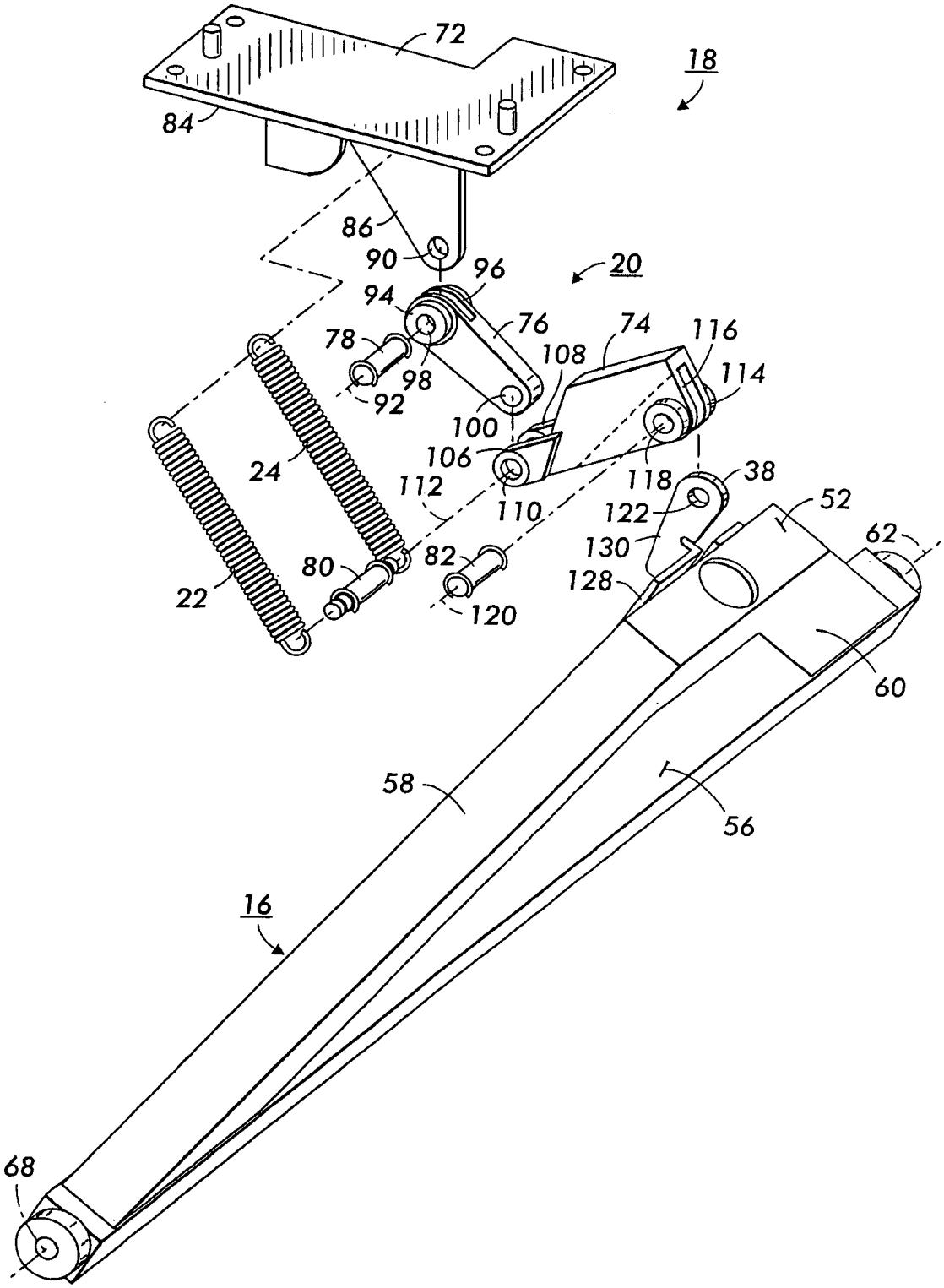
FIG. 5 is an exploded view of the tensioning device with the tensioning roller, roll frame and pivot pin removed.
Figure 6:
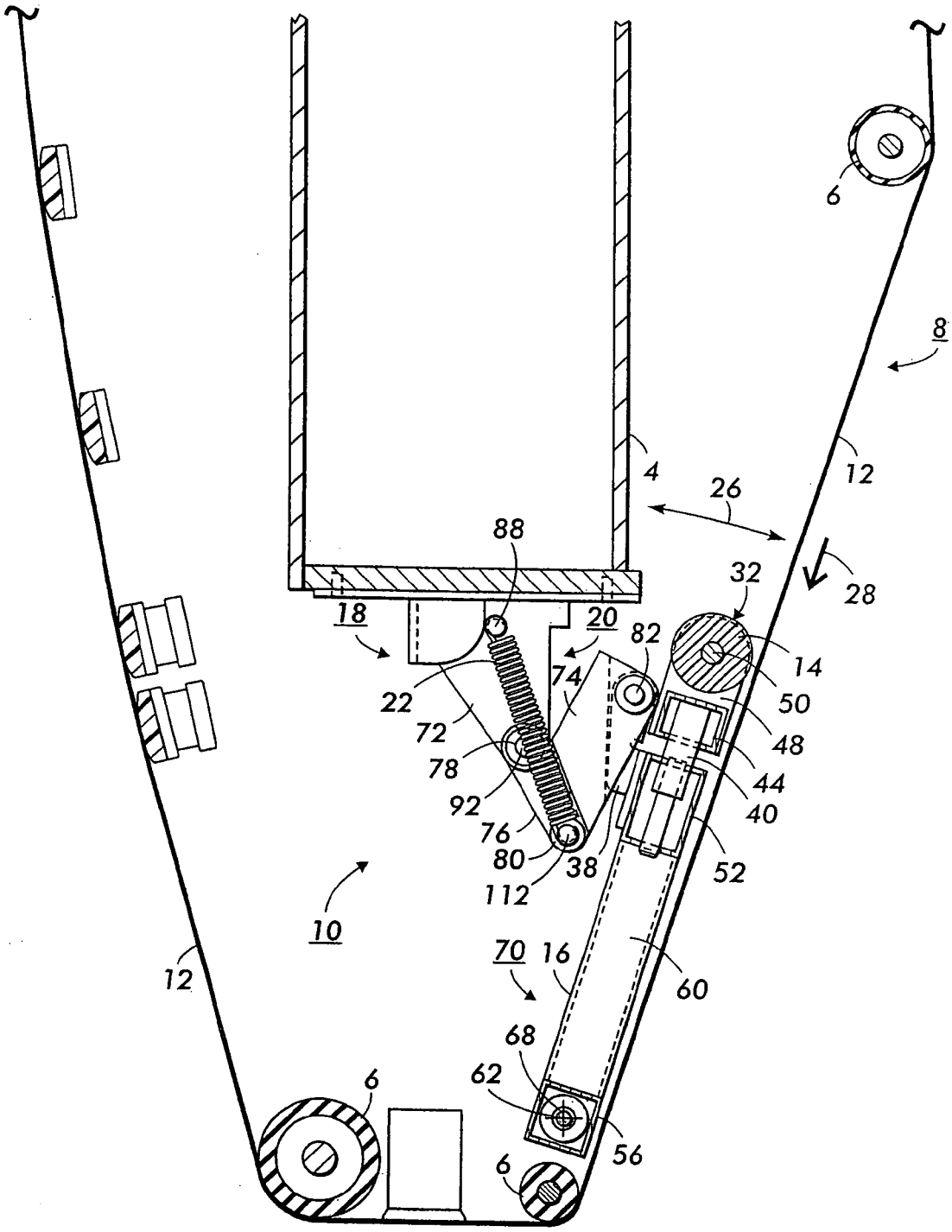
FIG. 6 is a side elevation view with parts broken away of the imaging device showing the tensioning device in a retracted position for facilitating removal, replacement or adjustment of the photoreceptor belt.

These figures merely illustrate the disclosed methods and apparatus and are not intended to exactly indicate relative size and dimensions of the device or components thereof.

DETAILED DESCRIPTION OF THE DRAWINGS

As shown, for example, in FIGS. 1–10, the disclosed photoreceptor belt tensioning device 10 compensates for static and dynamic changes in the length of a photoreceptor belt 12 mounted on rolls 6 for rotation relative to a frame 4 of an imaging device 8. The tensioning device 10 comprises a center-pivoting tensioning roll 14, an A-shaped frame 16 and a force exerting mechanism 18. The force exerting mechanism 18 uses a collapsible linkage 20 having extension springs 22, 24 mounted to each side for the self-adjustment of the tensioning roll 14. The tensioning device 10 utilizes the center pivoting tensioning roll 14 to create equal belt tension at the edges of the photoreceptor belt 12. The center pivoting tensioning roll 14 counteracts geometric artifacts and piece part/assembly tolerances which create a non-cylindrical wrapping surface for the photoreceptor belt 12. The disclosed pivoting belt tensioning device 10 is of low inertia and quick response to the self-balancing requirements of the photoreceptor belt 12 of the imaging device. The disclosed tensioning device 10 also costs less to manufacture than the current piston-type tensioning roll, which is a higher resistance system.

The disclosed tensioning device 10 provides a tensioning force with a magnitude that compensates for static and dynamic changes in the length of the photoreceptor belt 12. As the length of the photoreceptor belt 12 changes, the mechanical advantage of the collapsible linkage 20 changes to provide the desired tension to the belt 12, as shown, for example, in FIGS. 7 and 8.

During the manufacturing of photoreceptor belts 12, tolerances are provided for the length and conicity of the photoreceptor belts 12. Conicity is that aspect of the belt 12 wherein the diameter of the belt 12 along one side differs from the diameter of the belt 12 along the opposite side. Thus, photoreceptor belts 12 vary in length and conicity within certain specified manufacturing tolerances. Additionally, during use, the length of a photoreceptor belt 12 may change.

Figure 7:
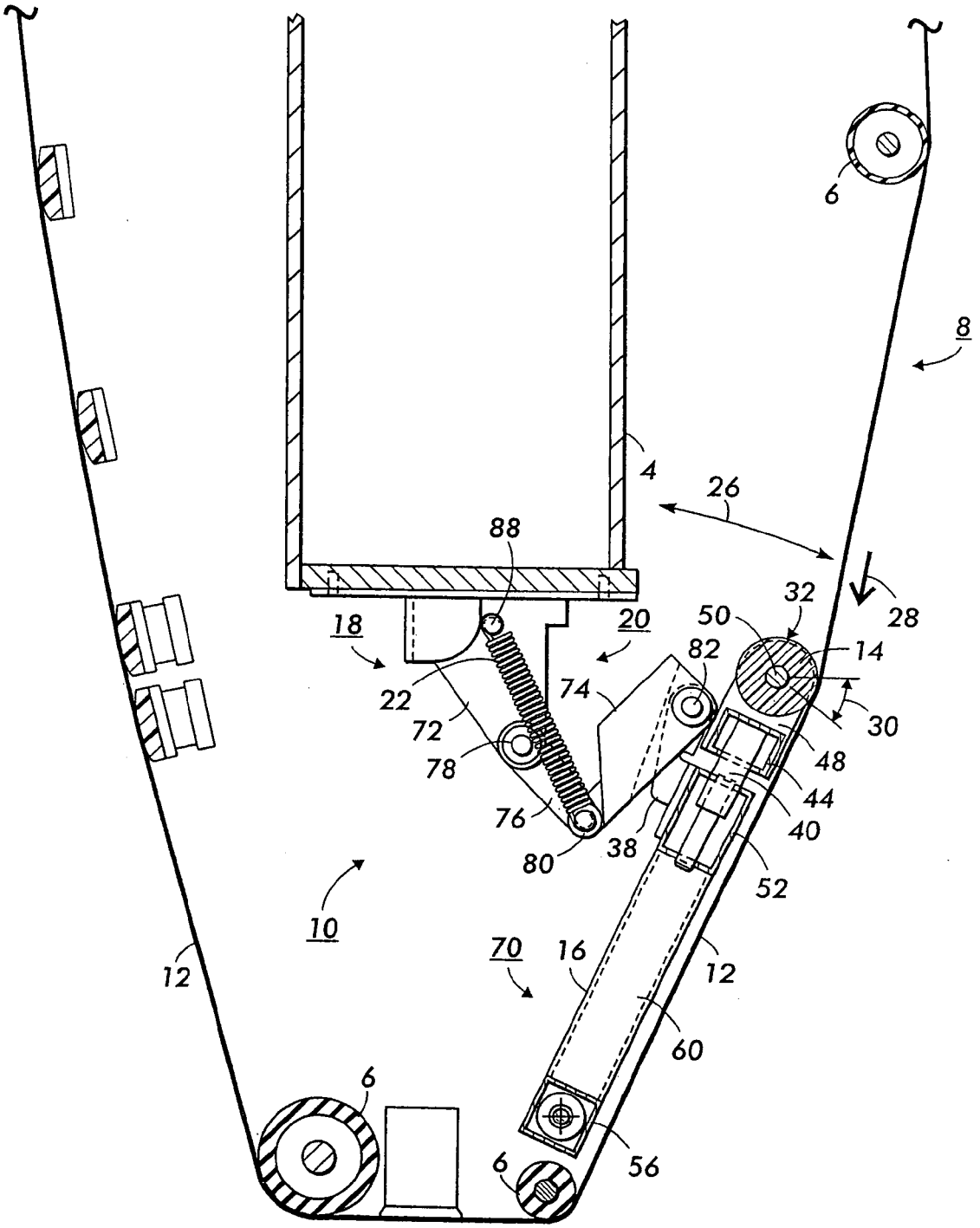
FIG. 7 is a side elevation view with parts broken away similar to FIG. 6 showing the tensioning device providing tension to a shorter photoreceptor belt.
Figure 8:
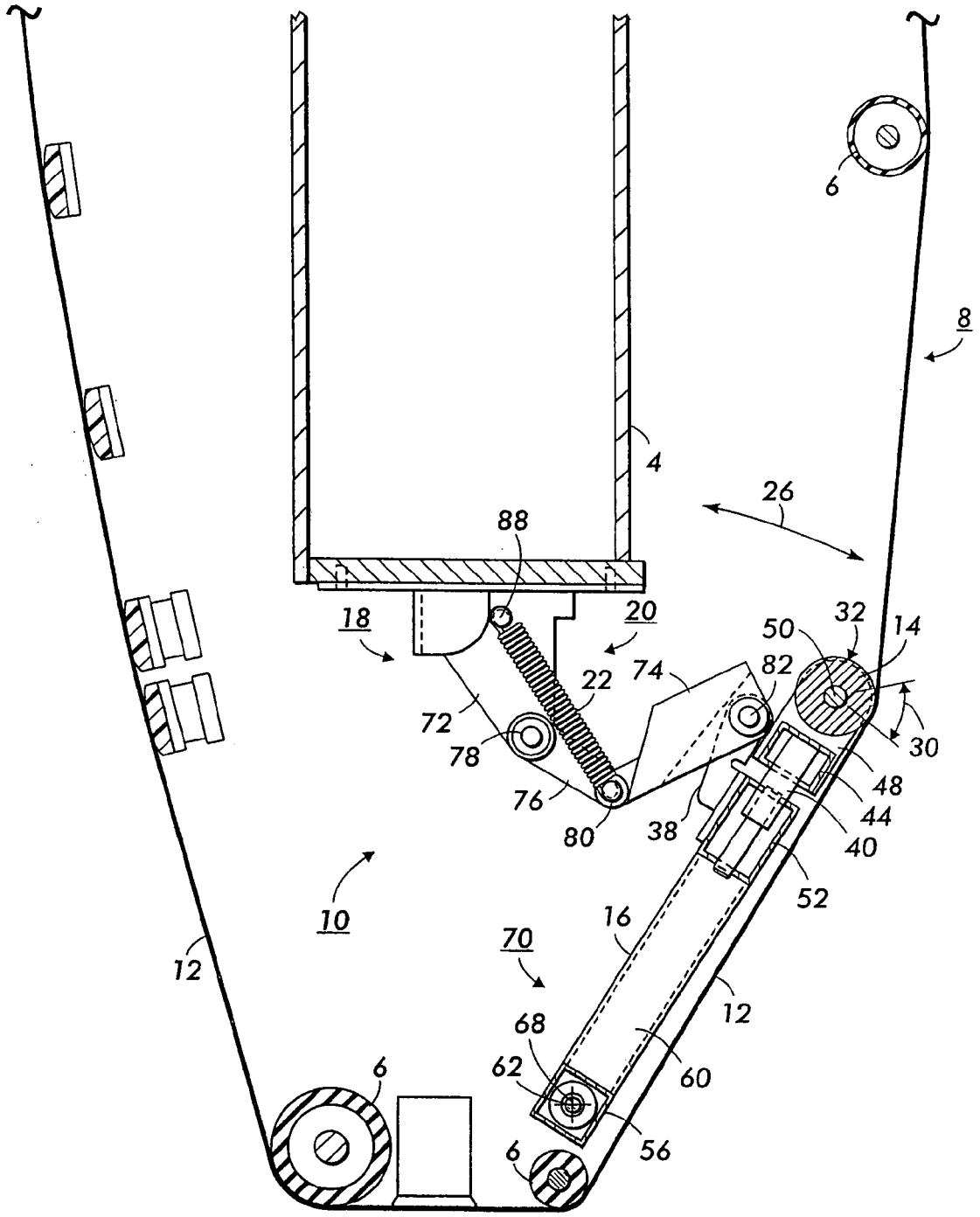
FIG. 8 is a side elevation view with parts broken away similar to FIG. 7 showing the tensioning device providing tension to a longer photoreceptor belt.
Figure 9:
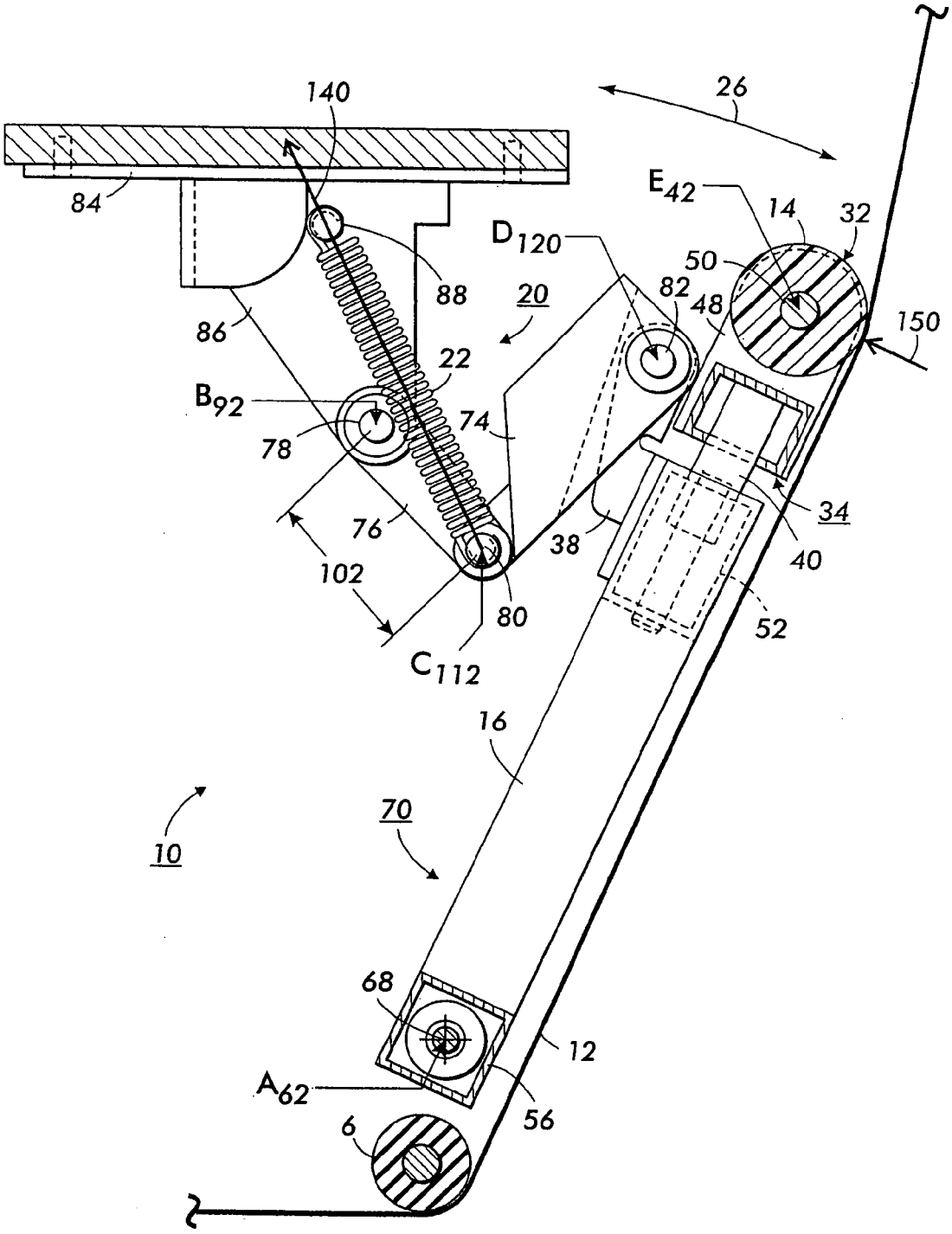
FIG. 9 is an enlarged view of a portion of FIG. 8.
Figure 12:
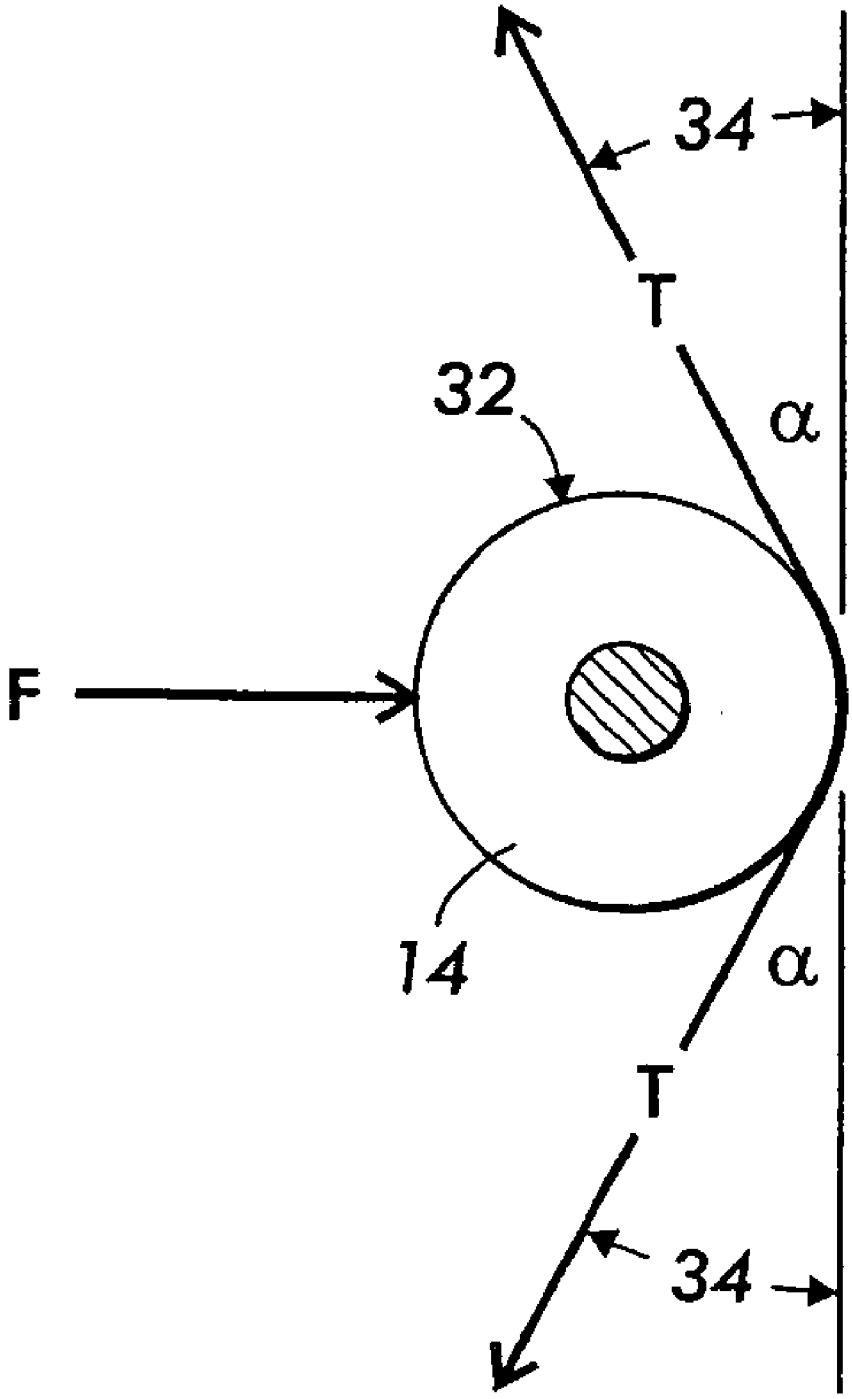
FIG. 12 is a force diagram showing the bisector of the wrap angle utilized to calculate tension in the belt.

To compensate for variability in the lengths of belts 12 the tensioning roll 14 must be able to translate along a plane 26 that is normal to the belt 12 and perpendicular to the process direction represented by arrow 28. Translation of the tensioning roll 12 in a plane 26 normal to the belt 12 and perpendicular to the process direction 28 causes the wrap angle ($2\alpha$) 30 around the tension roll 14 to change, as shown, for example, in FIGS. 7,8, 10 and 11. FIGS. 7 and 10 show the tensioning roll 14 pressing against a photoreceptor belt 12 having a first length to provide the photoreceptor belt 12 with the desired tension. In FIG. 10, the photoreceptor belt 12 engages the cylindrical surface 32 of the tensioning roll 14 along a surface area subtended by a wrap angle ($2\alpha_1$) 30. FIGS. 8,9 and 11 show a tensioning roll 14 pressing against a photoreceptor belt 12 having a second length which is greater than the first length to provide the photoreceptor belt 12 with the desired tension. In FIG. 12, the photoreceptor belt 12 engages the cylindrical surface 32 of the tensioning roll 14 along a surface area subtended by a wrap angle ($2\alpha_2$) 30. As can be seen by comparison of FIGS. 10 and 11, the wrap angle ($2\alpha_2$) is greater than the wrap angle ($2\alpha_1$). Thus, when the tensioning roll 14 supplies the same tension to a longer belt 12, the wrap angle ($2\alpha$) 30 increases.

Those skilled in the art will recognized that when the tensioning roll 14 exerts a force in a plane 26 that is normal to the belt 12 and perpendicular to the process direction 28, the tension on the belt 12 is related to the force and the wrap angle 30. When, as in the present tensioning device 10, the force is exerted through the bisector ($\alpha$) 34 of the wrap angle 30, the tension in the belt 12 can be represented by the following equation:

$$T = \frac{F}{2\sin\alpha}$$

wherein T is the tension in the belt 12, F is the magnitude of the force normal to the plane 26 of the belt 12 and perpendicular to the process direction 28, and $\alpha$ is the bisector 34 of the wrap angle 30. The force diagram is represented in FIG. 12.

From the above equation, it is apparent that, since the wrap angle 30 increase as the belt length increases, the force F must increase if a desired tension is to be maintained in the belt 12 as the length of the belt 12 increases. The disclosed tensioning device 10 utilizes the increasing mechanical advantage of the collapsible linkage 20 and the increasing torque exerted by the pivoting A-frame 16 to increase the force exerted on the belt 12 as the length of the belt 12 increases.

The illustrated tensioning device 10 includes the tensioning roll 14, a roll frame 34, the force exerting mechanism 18 implemented using the collapsible linkage 20, the A-frame weldment 16, a bracket 38 and a pivot pin 40. Tensioning roll 14 includes a cylindrical belt-engaging surface 32 formed concentrically about a longitudinal axis 42. Tensioning roll 14 is mounted to the roll frame 34 to rotate about its longitudinal axis 42. Roll frame 34 includes a cross member 44 and two mounting flanges 46, 48 extending perpendicularly from the cross member 44 at each end of the cross member 44. Illustratively, pins 50 extend inwardly from each flange 46, 48 to mount tensioning roll 14 to roll frame 34 so that tensioning roll 14 can rotate about its longitudinal axis 42.

The pivot pin 40 extends perpendicularly from the center of the cross member 44 of the roll frame 34 in the direction opposite to that in which the mounting flanges 46, 48 extend. The pivot pin 40 couples the roll frame 34 to the center of a top crossmember 52 of the A-frame weldment 16. In the illustrated embodiment, the pivot pin 40 includes a pivot axis 54 that is perpendicular to, and bisects, the longitudinal axis 42 of the tensioning roll 14 when the tensioning roll 14 is mounted in the roll frame 34. The roll frame 34 and the tensioning roll 14 mounted thereto are therefore mounted for pivotal movement about the pivot axis 54 of the pivot pin 50 relative to the A-frame weldment 16. This pivotal movement of the tensioning roller 14 allows the roller 14 to adjust for conicity of the photoreceptor belt 12.

The A-frame weldment 16 includes a lower cross member 56, the upper cross member 52, a left arm member 58 and a right arm member 60. The left arm member 58 extends between and couples the left ends of the upper cross member 52 and lower cross member 56. The right arm member 60 extends between and couples the right ends of the lower cross member 56 and upper cross member 52. The A-frame weldment 16 is formed such that the upper cross member 52 and lower cross member 56 are parallel to each other and so that the centers of the upper cross member 52 and lower cross member 54 coincide with the pivot axis 54 of the pivot pin 50. The lower cross member 56 includes a longitudinal axis 62. The lower cross member 56 is mounted to the frame 4 of the imaging device 8 for pivotal movement about a pivot axis 68 coinciding with the longitudinal axis 62. The pivot axis 68 is fixed relative to the frame 4 of the imaging device 8. Thus, the A-frame weldment 16 and the tension roll 14 mounted thereto pivot about the longitudinal axis 62 to enable the tensioning roll 14 to provide tension to the photoreceptor belt 12.

While the described tensioning device 10 utilizes an A-frame weldment 16, pivot pin 40 and roll frame 34, to act as a moment arm 70 for movement of the tensioning roll 14 about the longitudinal axis 62, it is within the scope of the disclosure for other linkages to act as such a moment arm 70. For example, a rectangular, H-shaped, T-shaped, I-shaped or other shaped weldment, a solid structure or other appropriately configured linkage could act as the moment arm 70 for pivotal movement of the tensioning roll 14 about the pivot axis 68.

The force exerting mechanism 18 is coupled to and configured to exert a force on the A-frame 16. The force exerting mechanism 18 exerts a force, through A-frame 16, the pivot pin 40 and tension frame 34 on the tensioning roll 16 mounted thereto, normal to the belt 12 and perpendicular to the direction 28 of belt motion. Illustratively, the force exerting mechanism 18 includes a fixed base 72, a yoke portion 74, a linkage 76, pivot pins 78, 80 and 82 and the springs 22 and 24. The linkage 76 is pivotally mounted to and couples the fixed base 72 and the yoke portion 74.

In the illustrated embodiment, the fixed base 72 is rigidly mounted to a cross member of the frame 4 of the imaging device 8 to provide a fixed pivot point for the link 76. The fixed base 72 also provides a fixed anchor point for a first end of the left and right extension springs 22, 24. The fixed base 72 is configured to include a plate 84 for mounting to the cross member and a flange 86 extending perpendicularly from the plate 84. Pins 88 extend perpendicularly from opposite sides the flange 86 to provide anchor sites for the first end of each of the springs 22, 24. A pin-receiving hole 90 is formed in the flange 86 through which pivot pin 78 is received to pivotally mount the link 76 to the fixed base 72 for pivotal movement about a pivot axis 92 (B). The pivot axis 92 is in a fixed position relative to the frame 4 of the imaging device 8.

The link 76 is formed at a first end to include two parallel spaced apart ears 94, 96. Each ear 94, 96 is formed to include a pivot pin-receiving hole 98 therethrough. The ears 94, 96 are spaced apart sufficiently to receive the portion of the flange 86 of the fixed base 72 which includes the pin-receiving hole 90 therebetween. Pivot pin 78 extends through pin receiving holes 90 and 98 to mount the link 76 to the fixed base 72 for pivotal movement about the pivot axis 92. At the opposite end of the link 76 a pin-receiving hole 100 is formed through the link 76 through which pivot pin 80 is received to mount yoke 74 to link 76. In the illustrated embodiment, the centers of pin-receiving holes 98 and 100 are displaced from one another by a displacement 102 so that link 76 acts as a moment arm 104 having a length 102. In the illustrated embodiment, the displacement 102 is approximately 38.0 mm.

The yoke portion 74 is formed to include a first end with two spaced apart ears 106, 108 extending therefrom parallel to each other. Each ear 106, 108 is formed to include a pivot pin-receiving hole 110 therein. The ears 106, 108 are spaced apart sufficiently to allow the end of the link 76 including the pin-receiving hole 100 to be received therebetween. The pivot pin-receiving holes 110 are located so that the pivot axis 112 of the pin 80 extending therethrough is perpendicular to both ears 106, 108. Thus yoke 74 is formed to include pin-receiving holes 110 through which the pivot pin 80 (C) is received to mount the yoke 74 to the link 76 for pivotal movement relative to the link 76 about the axis 112 of the pivot pin 80 (C). Opposite ends of pivot pin 80 (C) also act as anchor locations for the second ends of the springs 22, 24.

The yoke portion 74 is also formed to include a second end with two spaced apart ears 114, 116 extending therefrom parallel to each other. Each ear 114, 116 is formed into include a pivot pin-receiving hole 118 therein. The pivot pin-receiving hole s 118 are located so that the pivot axis 120 of the pivot pin 82 extending therethrough is perpendicular to both ears 114, 116. Ears 114, 116 are spaced apart sufficiently to permit the portion of the bracket 38 including pivot pin-receiving hole 122 to be received therebetween. In the illustrated embodiment, the centers of pin-receiving hole s 110 and 118 are displaced from one another by a displacement 124 so that yoke 74 acts as a moment arm 126 having a length 124. In the illustrated embodiment, the displacement 124 is approximately 62.0 mm.

The A-frame weldment 16 is coupled to the yoke 74 by the bracket 38. The bracket 38 is formed to include a base plate 128 and a flange 130. The flange 130 is formed in a plane perpendicular to the plane in which the base plate 128 is formed. The base plate 128 is configured to be rigidly attached to the top cross member 52 of the A-frame weldment 16. The flange 130 is formed to include the pivot pin-receiving hole 122 therein having an axis parallel to the plane of the base plate 128. The pivot pin 82 extends through mounting hole s 118 formed in each ear 114, 116 of the yoke 74 and the pivot pin-receiving hole 122 formed in the flange 130 of the bracket 38 to couple the A-frame weldment 16 to the yoke 74 of the force exerting mechanism 18.

As shown, for example, in FIGS. 6–9 and 13, the link 76 is mounted to the fixed base 72 for pivotal movement about the fixed pivot axis 92 of the pivot pin 78 (B). The yoke portion 74 is pivotally mounted to the link 76 for pivotal movement about the pivot axis 112 (C) of the pivot pin 80. One end of each of the extension springs 22, 24 is mounted to fixed base 72 to an associated one of the fixed anchor pins 88 extending laterally from each side of the flange 86 of the fixed base 72. The other end of each of the extension springs 22, 24 is mounted to the pivot pin 80 coupling the yoke portion 74 to the link 76.

Thus, the link 76 and yoke portion 74 form the collapsible link age 20. The collapsible link age 20 is mounted at one end to pivot about the fixed pivot axis 92 (B) of the pivot pin 78 coupling the link 76 to the fixed base 72. The collapsible link age 20 has a moment arm component 104 formed by the link 76 extending between pivot pin 78 and pivot pin 80 and a moment arm component 126 formed by the yoke 74 extending between the pivot pin 80 and the pivot pin 82.

Figure 13:
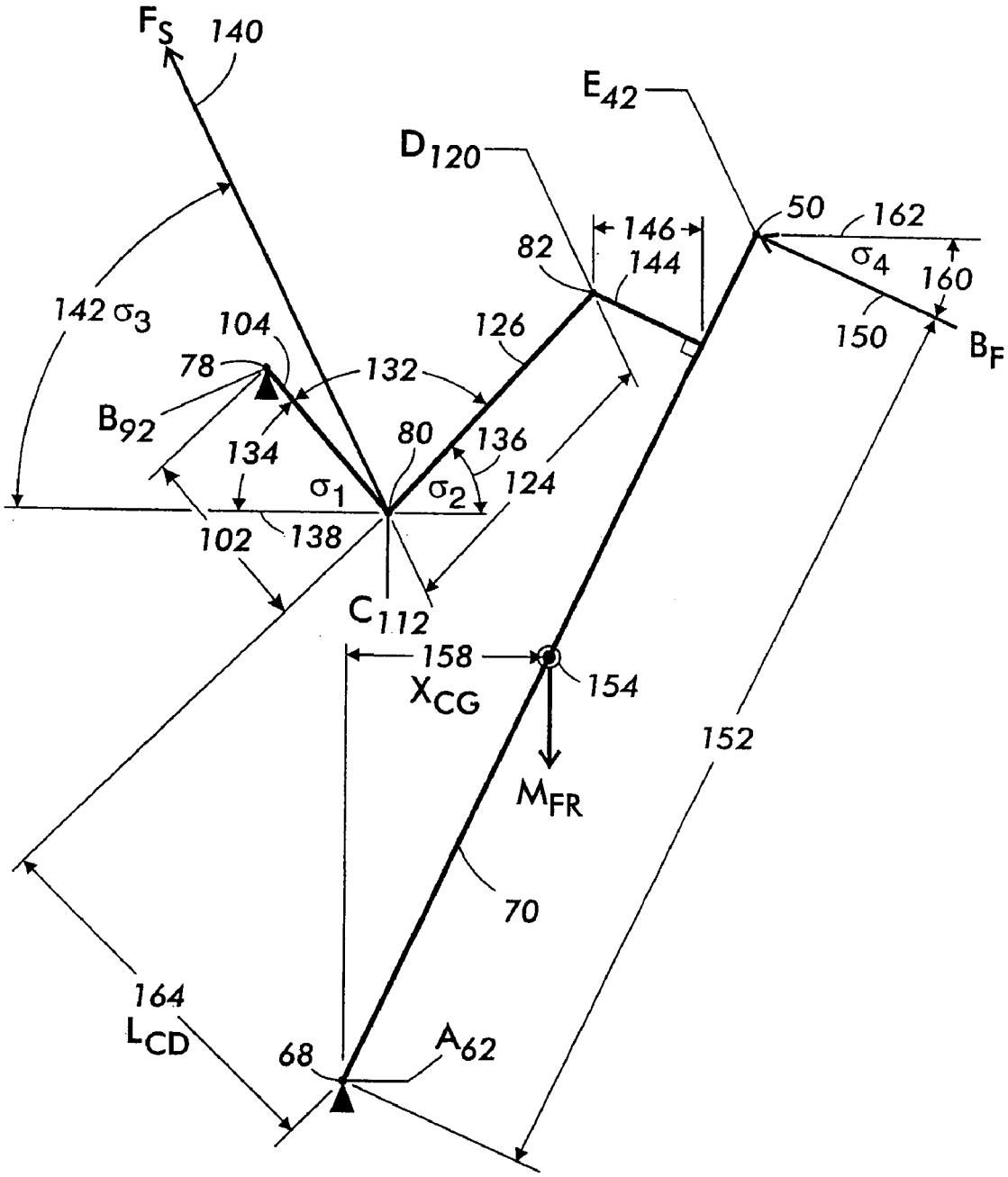
FIG. 13 is a force diagram showing the forces, moment arms and pivot points for the tensioning mechanism.

A free body diagram of the tensioning device 10 is shown in FIG. 13. As shown, in FIG. 13, each of the pivot axes 68, 92, 112 and 120 of the tensioning device 10 are parallel to each other and parallel to the axis of symmetry of the A-frame weldment 16. In FIG. 13, the line segment BC represents the effective moment arm 104 formed by link 76 between the pivot axis 92 (B) of the pivot pin 78 and the pivot axis 112 (C) of the pin 80 coupling the yoke 74 to the link 76. Thus line segment BC has a length 102 (represented in equations hereafter as $\sigma_1$) equal to the displacement 102 between the centers of the pivot pin-receiving holes 98 and the pin-receiving hole 100 formed in the link 74 of the force exerting mechanism 18. Line segment CD represents the effective moment arm 126 formed by the yoke 74 and thus has a length 124 equal to the displacement 124 between the centers of the pin-receiving hole 110 and the pin-receiving holes 118 in the yoke 74. The second end of springs 22, 24 is fixed to the pivot pin 80 having the pivot axis 112 which defines point (C) of line segments BC and CD. The moment arm 104 and moment arm 126 form an angle 132 with respect to each other about pivot axis 112 (C). The angle 132 between moment arm 104 and moment arm 126 is ($180-\sigma_1-\sigma_2$). Angles $\sigma_1$ 134 and $\sigma_2$ 136 are measured from a horizontal line 138 tangent to the pivot axis 112 (C) forming the apex of the angle 132 formed by moment arm 104 and moment arm 126. Since gravitational forces are exerted on the A-frame weldment 16, horizontal line 138 is a convenient reference for determining the angle 132 between moment arm 104 and moment arm 126.

In FIG. 13, the force exerted by the springs 22, 24 is along the direction of a ray 140 forming an angle 142 $\sigma_3$ with the horizontal line 138 tangent to the pivot axis 112 (C) forming the apex of the angle 132 formed by moment arm 102 (BC) and moment arm 126 (CD) from which angles 134 ($\sigma_1$) and 136 ($\sigma_2$) are measured. The springs 22, 24 exert a force proportion al to their displacement from their equilibrium position on the pivot axis 112 that biases the moment arm 126 to pivot about the pivot axis 112 relative to moment arm 104 so that the angle 132 between the moment arms 104 and 126 is biased to increase. The belt 12, when tensioned, exerts a force ( in the direction of ray 150) through the tensioning roll 14, roll frame 34, pivot pin 40, the A-frame weldment 16 and bracket 38 that counteracts the biasing effect of the springs 22, 24 on the collapsible link age 20. Thus, as the link 76 and the yoke 74 pivot about the pivot axis 92 (B) and pivot relative to each other about pivot axis 112 (C), the value of angles 134 $\sigma_1$, 136 $\sigma_2$ and 142 $\sigma_3$ change.

In the illustrated embodiment, the bracket 38 and pivot pin 82 pivotally couple the collapsible link age 20 to the top cross member 52 of the A-frame weldment 16 for movement about pivot axis 120 (D). The force that is exerted on the A-frame weldment 16 by the force exerting mechanism 18 is thus perpendicular to the plane of the A-frame weldment 16. In FIG. 13, the short line segment 144 extending from the pivot axis 120 (D) to the moment arm 70 represented by line segment AE is perpendicular to line segment AE and has a length 146 equal to the displacement of the center of pivot-pin receiving hole 122 from the plane of symmetry of the A-frame weldment 16.

In the illustrated embodiment, the line segment AE represents the moment arm 70 created by the A-frame weldment 16, the pivot pin 40, the roller frame 34 and the tensioning roll 14. Thus, the moment arm 70 has a length 152 equal to the distance between the fixed pivot axis 68 (A) extending through the bottom cross member 56 of the A-frame weldment 16 and the longitudinal axis 42 (E) about which the tensioning roll 14 rotates. Because the A-frame 16 is not vertically mounted to the frame 4 of the imaging device 8, gravity acting on center of mass 154 of the A-frame weldment 16, the pivot pin 40, the roller frame 34 and the tensioning roll 14 mounted thereto generates a torque about the pivot axis 68 (A). The center of gravity 154 of the A-frame weldment 16, the pivot pin 40, the roller frame 34 and the tensioning roll 14 mounted thereto is displaced horizontally from the vertical line 156 running through pivot axis 68 (A) by a displacement 158 ($X_{CG}$). This displacement 158 ($X_{CG}$) increases and decreases as the moment arm 70 pivots about pivot axis 68 to compensate for variances in the length of the photoreceptor belt 12. The combined mass of the moment arm 70 created by the A-frame weldment 16, the pivot pin 40, the roller frame 34 and the tensioning roll 14 mounted thereto is represented by $M_{FR}$ in FIG. 13. Thus, the torque generated by the moment arm 70 is equal to the displacement 158 ($X_{CG}$) times the combined mass $M_{FR}$ of the moment arm 70 times the acceleration due to gravity (generally represented as 9.81 m/sec$^2$. Examination of FIGS. 7, 8 and 13 establishes that as the length of the belt 12 increases, the displacement 158 ($X_{CG}$) increases resulting in a larger torque being generated by pivotal moment arm 70. As mentioned above, this increase in torque is one component of the increase in force required to maintain a selected tension on the belt 12 as the length of the belt 12 increases.

As mentioned above, the tensioning roller 14 exerts a force normal to the belt 12 perpendicular to the direction of movement 28. This force is equal to, but in the opposite direction from, the force (represented by ray 150) that the belt 12 exerts on the tensioning roller 14. Because, the A-frame 16 is not vertically mounted to the frame 4 of the imaging device 8, the force exerted by the tensioning roll 14 on the photoreceptor belt 12 is not horizontal but forms an angle 160 $\sigma_4$ with respect to the horizontal 162, as shown for example, in FIG. 13. As the length of the belt 12 increases and decreases, the value of the angle 160 $\sigma_4$ also increases and decreases.

Referring to FIGS. 7–9 and 13, it can be understood that, as the length of the belt 12 increases, the value of angles 134 $\sigma_1$, 136 $\sigma_2$, and 142 $\sigma_3$ decrease while the angle 160 $\sigma_4$ increases. Additionally, because springs 22, 24 are extension springs extended from their equilibrium length, as the belt 12 gets longer the length of the springs 22, 24 get shorter so the displacement length of the springs 22, 24 gets shorter. Thus, under Hooke's law the force exerted by the springs 22, 24 decreases in magnitude. However, as moment arm 104 and moment arm 126 pivot about pivot axis 112 to adjust for the increase in the length of the belt 12 the effective moment arm 164 ($L_{CD}$) for the collapsible link age 20 increases providing an increased mechanical advantage. As mentioned above, this increase in mechanical advantage of the collapsible link age 20 is another component of the increase in force required to maintain a selected tension on the belt 12 as the length of the belt 12 increases.

If the decrease in spring force is minimal with respect to the increase in the effective moment arm 164 of the collapsible link age 20, then for purposes of determining belt tension, the spring force can be represented as a constant. Thus, from FIG. 13, it is apparent that the force ($F_{CD}$) exerted by the collapsible link age 20 can be represented as:

$$F_{CD} = F_S \frac{(\sin\sigma_3 \cdot \cos\sigma_1 + \cos\sigma_3 \cdot \sin\sigma_1)}{(\sin\sigma_2 \cdot \cos\sigma_1 + \cos\sigma_2 \cdot \sin\sigma_1)}$$

The force exerted on the belt BF is equal to the force exerted by the collapsible link age 20 times the length of the effective moment arm 164 ($L_{CD}$) for the collapsible link age 20 plus the torque induced by gravitational forces on the center of gravity 154 of the moment arm 70. Referring to the free force diagram of FIG. 13, the force applied to the belt 12 can then be modeled by the equation $$B_F = (F_{CD} \cdot L_{CD}) + (M_{FR} \cdot X_{CG} \cdot g)$$

where g represents the acceleration due to gravity (9.81 m/sec$^2$ in the MKS system). From the above equation, it is apparent since the effective moment arm 164 ($L_{CD}$) of the collapsible link age 20 increases and the displacement 158 ($X_{CG}$) of the center of gravity of the moment arm 70 increases as the length of the belt 12 increases, then the force $B_F$ exerted on the belt 12 increases as the length of the belt 12 increases. This increase in force $B_F$ on the belt 12 as the length of the belt 12 increases is necessary to maintain a desired tension in the belt 12 as explained above.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A tensioning device for minimizing tension variations in a moveable endless belt having a desired tension setting and configured to be mounted for rotation about rollers mounted to a frame, the tensioning device comprising:

a moveable member for mounting transversely to a direction of movement of the moveable endless belt said moveable member being movable into contact with the moveable endless belt;

a force exerting mechanism comprising a first moment arm, a second moment arm and a biaser, the first moment arm being coupled at a first end to the frame for pivotal movement of the first moment arm about a pivot fixed relative to the frame and a second end coupled to a first end of the second moment arm, the second moment arm having a second end coupled to the moveable member and being coupled at the first end for pivotal movement relative to the first moment arm about a moveable pivot coupling the first and second moment arms and the biaser being coupled to the frame and the moveable pivot to bias the moveable pivot to urge the second end of the second moment arm away from the fixed pivot thereby urging the moveable member into contact with the moveable endless belt, thereby tensioning the moveable endless belt and minimizing variations from the desired tension setting of the moveable endless belt.

2. The device of claim 1, wherein said moveable member has a convex surface for forming a wrap angle with an inner surface of the moveable endless belt.

3. The device of claim 1, and further comprising an assembly including a rotatable arm having a first end connected to said moveable member and a second end coupled to a second pivot fixed relative to the frame the assembly being coupled to the second end of the force exerting mechanism wherein the assembly and the moveable member form a moment arm having a mass and a center of gravity and the displacement of the center of gravity from a vertical line running through the second pivot increases as the moveable member is moved into contact with the moveable endless belt.

4. The device of claim 3, wherein said biaser includes an extension spring.

5. The device of claim 3, wherein the mechanical advantage of a linkage formed by the first and second moment arms increases as the length of the moveable endless belt increases inducing the force exerting mechanism to generate more force as the length of the moveable endless belt increases.

6. The device of claim 5, wherein a torque generated about the second pivot by the weight of the moment arm induces the tensioning device to generate more force against the moveable endless belt as the length of the moveable endless belt increases.

7. A tensioning device for minimizing tension variations in a moveable endless belt having a first edge having a diameter, a second edge having a diameter, a desired tension setting and being configured to be mounted for rotation about rollers mounted to a frame, the tensioning mechanism comprising:

a first assembly having a first end and a second end, the first end being coupled to the frame for pivotal movement of the first assembly about a first pivot axis fixed relative to the frame, the first pivot axis being transverse to the endless moveable belt;

a second assembly including a biased collapsible linkage having a first end coupled to the first assembly and a second end coupled to a second pivot axis fixed relative to the frame, the collapsible linkage being biased to urge the second end of the first assembly to pivot away from the second pivot axis toward the movable endless belt and being configured to increase its mechanical advantage as the first assembly pivots away from the second pivot axis;

a moveable member having a longitudinal axis and a surface for contacting the moveable endless belt transversely to a direction of movement of the moveable endless belt, the movable member being coupled to the second end of the first assembly for pivotal movement about a third pivot axis transverse to the longitudinal axis; and wherein the first and second assembly cooperate to urge the contact surface of the moveable member into engagement with the moveable endless belt with the longitudinal axis parallel to the direction of movement of the moveable endless belt regardless of whether the diameter of the first edge is equal to the diameter of the second edge and wherein the contact surface applies a tensioning force to the moveable endless belt having a force direction that is orthogonal relative to the direction of movement of the moveable endless belt, thereby tensioning the moveable endless belt.

8. The tensioning device of claim 7, wherein the moveable member and the first assembly comprise a moment arm having a center of mass acted upon by gravity to create a torque component of the tensioning force that increases as the first assembly pivots away from the second pivot axis.

9. The tensioning device of claim 7, wherein the third pivot axis is transverse to the first pivot axis.

10. The device of claim 9 wherein the third pivot axis is transverse to the second pivot axis.

11. The device of claim 10 wherein the collapsible linkage includes a first moment arm coupled for pivotal movement about the second pivot axis and a second moment arm couple for movement relative to the first moment arm about a fourth pivot axis moveable relative to the frame.

12. The device of claim 11 wherein the collapsible linkage includes a spring coupled at one end to an anchor point fixed relative to the frame and coupled at a second end to the fourth pivot axis.

13. The device of claim 12 wherein the moveable member has a convex contact surface for forcing a wrap angle with an inner surface of the moveable endless belt.

14. The device of claim 13, wherein the moveable member is a roller.

15. An apparatus for providing tension to a photoreceptor belt mounted for rotation about a plurality of fixed rollers mounted to a frame of an imaging device, the tensioning apparatus comprising:

a tensioning roller having a longitudinal axis and a convex contact surface for forcing a wrap angle with an inner surface of the photoreceptor belt;

a first moment arm mounted at a first end to an imaging device frame for pivotal movement relative to the frame about a first pivot axis fixed relative to the frame and mounted at a second end to the tensioning roller; and a force exerting mechanism mounted to the frame and coupled through the first moment arm to the tensioning roller, the force exerting mechanism comprises a second moment arm, a third moment arm and a biaser, the second moment arm being coupled at a first end to the frame for pivotal movement of the second moment arm about a second pivot axis fixed relative to the frame and a second end coupled to a first end of the third moment arm, the third moment arm having a second end coupled to the first moment arm and being coupled at the first end for pivotal movement relative to the second moment arm about a moveable pivot coupling the second and third moment arms and the biaser being coupled to the frame and the moveable pivot to bias the moveable pivot to urge the second end of the third moment arm away from the second fixed pivot axis so the first moment arm is urged toward the photoreceptor belt to provide a force perpendicular to the longitudinal axis of the tensioning roller and urge the contact surface of the tensioning roller into engagement with the inner surface of the photoreceptor belt, the force exerting mechanism being configured to increase the force exerted as the length of the photoreceptor belt increases.

16. The apparatus of claim 15 wherein the mechanical advantage of a linkage formed by the second and third moment arms increases as the length of the photoreceptor belt increases.

17. The apparatus of claim 15 wherein the first moment arm and the tensioning roller comprise an assembly having a center of mass acted upon by gravity to create a torque component urging the tensioning roller into engagement with the photoreceptor belt that increases as the length of the photoreceptor belt increases.

18. The apparatus of claim 17 wherein the mechanical advantage of a linkage formed by the second and third moment arms increases as the length of the photoreceptor belt increases.

19. The apparatus of claim 18 wherein the tensioning roller is mounted to the first moment arm to rotate about the longitudinal axis of the tensioning roller and for pivotal movement about a pivot axis perpendicular to the longitudinal axis.

* * * * *